United States Patent [19]

Taylor et al.

[11] Patent Number: 4,471,880

[45] Date of Patent: Sep. 18, 1984

[54] CENTER PRESS OUTER SEAL BOWL LID

[75] Inventors: William D. Taylor; Richard D. Dilyard, both of Wooster, Ohio

[73] Assignee: Rubbermaid Incorporated, Wooster, Ohio

[21] Appl. No.: 538,515

[22] Filed: Oct. 3, 1983

[51] Int. Cl.[3] ..... B65D 41/16; B65D 41/18

[52] U.S. Cl. ..... 220/306; 150/55

[58] Field of Search ..... 220/306, 307; 150/55

[56] References Cited

U.S. PATENT DOCUMENTS

| | | | |
|---|---|---|---|
| Re. 24,899 | 10/1960 | Tupper | 150/0.5 |
| 2,487,400 | 11/1949 | Tupper | 150/9.5 |
| 3,111,240 | 11/1963 | Whitton, Jr. | 220/67 |
| 3,692,208 | 9/1972 | Croyle et al. | 220/307 |
| 4,341,324 | 7/1982 | Ramirez | 220/306 |
| 4,349,119 | 9/1982 | Letica | 220/306 |
| 4,387,828 | 6/1983 | Yates, Jr. | 220/306 |
| 4,426,014 | 1/1984 | Coltman, Jr. | 220/307 |

*Primary Examiner*—George T. Hall

*Attorney, Agent, or Firm*—Renner, Kenner, Greive & Bobak

[57] ABSTRACT

A resilient plastic lid closure (10) for the upper rim (20) or a bowl (15) or the like, said lid having a downturned periphery (16) terminating in an outer rim flange (18) for snapping over the rim (20) when pressed downwardly at the medial portion (11) of the lid, thereby forming a tight seal with the outer surface of the bowl rim (20) when pressure on the medial portion (11) of the lid (10) is released.

14 Claims, 9 Drawing Figures

FORCE
16
17
18
19
19a
20
22
23
24
$\frac{1}{2}x$
12°
7°
a
b
a>b

CENTER PRESS OUTER SEAL BOWL LID

TECHNICAL FIELD

The invention relates to flexible plastic lids for plastic containers adapted to store foods in refrigerators and freezers, and more particularly to plastic lids adapted to be placed in sealing position on the container by applying downward pressure to the center of the lid.

BACKGROUND ART

With the advent of plastic food containers a number of lid constructions have been proposed for sealing the contents to keep out ambient air. Difficulties have been encountered in maintaining a tight seal, especially when the closed containers are refrigerated.

U.S. Pat. No. 2,487,400 discloses a flexible plastic cover for an open mouth container, said lid having a recessed top wall with an inverted U shaped rim for fitting over the lip of the container. The lid is described as having elasticity and flexibility with a slow rate of recovery to provide a non-snapping and noiseless type of cover. It is applied to the container by pressing down on the rim progressively along its top wall to effect a spreading of the side groove walls and an expansion or compression of the central wall to effect sealing engagement between the container rim and the inner surfaces of the top and sidewalls of the container rim. Because of the use of plastic material having high flexibility to obtain a non-snapping cover, this construction does not provide a tight seal, especially under refrigerating conditions. Moreover, the recessed top wall of the lid materially reduces the capacity of the container for containing foods.

The Tupper U.S. Pat. No. Re. 24,889 is said to be an improvement over U.S. Pat. No. 2,487,400, and is directed to a rectangular container and cover with rounded corners, the major difference being a bead on the upper rim of the container and inclined inner surfaces on the walls of the peripheral rim groove of the cover forming sealing points with the bead. The cover is of flexible material and is designed to be applied by progressive finger pressure along the top wall of the rim of the cover. This construction has the same disadvantages as the cover of U.S. Pat. No. 2,487,400, including a poor seal and the loss of food capacity of the container due to the recessed top wall of the lid.

The Whitton U.S. Pat. No. 3,111,240 also shows a bead on the container rim which has an inclined surface cooperating with inclined inner surfaces on the interior of a peripheral rim groove to provide secondary seals. However, the primary seal is formed between the smooth inner surface of the container rim and the inner wall of the peripheral rim of the cover and also the recessed lid decreases the capacity of the container.

The Croyle U.S. Pat. No. 3,692,208 discloses a plastic cover having a downwardly concave or conical central wall encircled by an upwardly directed inverted U-shaped annular rim. The inner wall of the rim makes the seal with the inner surface of the bowl rim, thus it is an inner seal as distinguished from the outer seals of the Tupper patents, and there is no sealing contact between the outer surface of the bowl rim and the outer wall of the rim. The downwardly concave central wall of the cover when pressed downwardly contracts the inner wall of the rim to allow it to pass within the rim of a container, and the material of the cover has an elastic memory to expand when released into sealing contact with the inner surface of the container. However, such a cover tends to shrink radially inward when refrigerated, thus diminishing or weakening the seal, and again there is a loss of capacity of the container due to the recessed lid.

DISCLOSURE OF THE INVENTION

The improved lid of the present invention overcomes the disadvantages of the foregoing prior art lids and provides a lid which is snapped into sealing engagement with the outer surface of a bowl rim by applying downward pressure to the medial area of the lid, thus providing an audible signal that the seal is completed.

It is an object of the present invention to provide an improved lid of plastic material having a top wall with a downturned rim adapted to seal with the smooth outer surface of a bowl rim.

Another object is to provide an improved lid of plastic material having an upwardly bulged top wall with a resilient downturned rim area, said plastic material having sufficient beam strength in its top wall to allow the rim area to expand radially and snap into sealing engagement with the outer surface of a bowl rim when the medial area of the lid is pressed downwardly.

A further object of the invention is to provide an improved lid adapted to seal with the outer surface of the bowl rim in such manner as to enhance the seal when the assembled bowl and lid are refrigerated.

A still further object is to provide an improved lid adapted to effect a seal with the outer rim surface of a bowl, said lid having an upwardly bulged top wall adapted to increase the capacity of the container when the lid is in sealing engagement with said bowl.

Still another object is to provide an improved lid having an upwardly bulged top wall with a downturned rim area adapted to effect a seal with the outer rim surface of a bowl, said top wall having sufficient beam strength to support a plurality of filled bowls stacked thereon without detracting from the effectiveness of the seal with the outer rim surface of the lowermost bowl.

These and other objects are accomplished by the construction of the improved lid and its coaction with a bowl rim when downward pressure is applied to the lid placed on the bowl, preferred embodiments of the invention being disclosed herein by way of example as exemplifying the best known manner of carrying out the invention. Various modifications and changes in details of construction are comprehended within the scope of the appended claims.

PREFERRED EMBODIMENTS FOR CARRYING OUT THE INVENTION

The improved lid is molded of a semi-rigid plastic material having some resiliency and a substantial amount of beam strength in the span across a diameter between opposite points on the downwardly curved rim. A preferred material is linear low density polyethylene (LLDPE), although other plastic materials having similar physical properties may be used. Preferably, the lid is molded in molds at about 150° F. which preshrinks it so there is minimal additional shrinkage when treated in a dishwasher.

The proportionate diameter and height dimensions of the lid vary somewhat with respect to lids of different diameters for fitting bowls or containers of different sizes, as does the thickness of the material. Thus, for lids of 8" to 4" inches diameter, the thickness may vary from 0.095" to 0.055". The lid stiffness is a function of the fourth power of the rim thickness. In order to effect a seal between the inner surface of the arcuate rim and the outer surface of the bowl rim by pressing down on the medial area of the lid, the stiffness of the rim, the height of the curved rim and the beam strength between opposite points on the rim, (which is a function of the third power of the lid span) all must be correlated so that when the lid is pressed down at its medial portion the force transmitted to the rim causes substantially half the rim to first seat on the bowl rim, and the other half of the rim will then progressively move down between diametrically opposite points and finally complete the seal midway between said points with an audible snap or click. The diameter of the sealing surface on the inside of the rim of the lid must be slightly less than the outer diameter of the bowl rim in order to move over the bowl rim and obtain the audible snap at the completion of the seal without requiring excessive pressure at the medial portion of the rim. For a 6 inch diameter lid the diameter of its sealing surface should be about 0.070" less than the outer diameter of the bowl rim and this dimension varies with lids of different diameters as follows:

| Overall Lid Diameter | Differential (x) Between Lid I.D. and Bowl Rim O.D. |
|---|---|
| 8" | .090" less |
| 7" | .080" less |
| 6" | .070" less |
| 5" | .060" less |
| 4" | .050" less |

Figure 1:
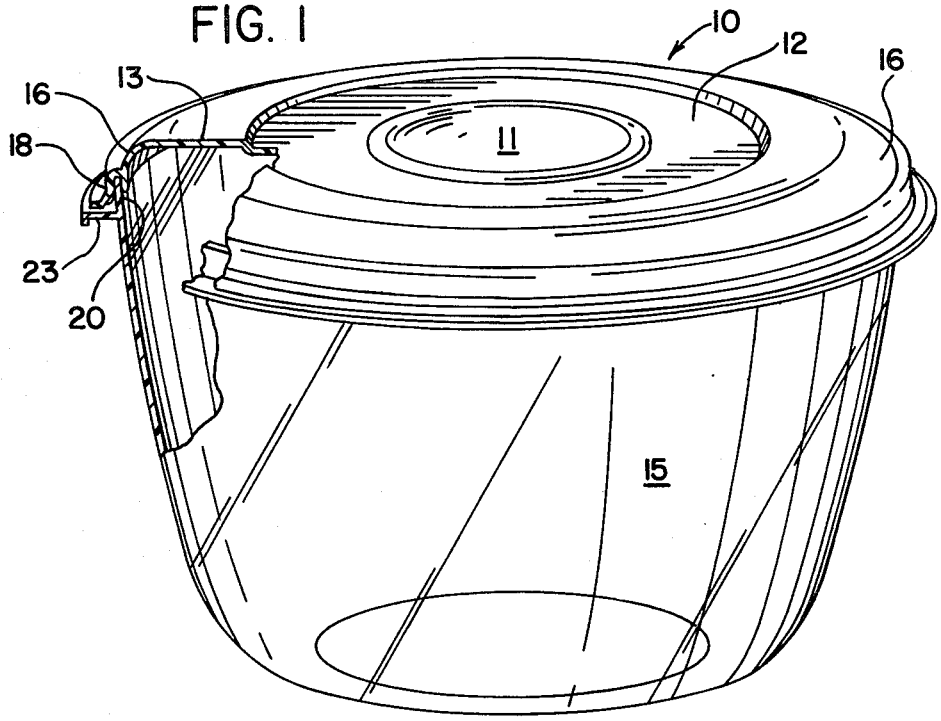
FIG. 1 is a perspective view, partly broken away and in section, of one preferred embodiment of the improved lid in sealing position on a bowl having a smooth upper rim.
Figure 2:
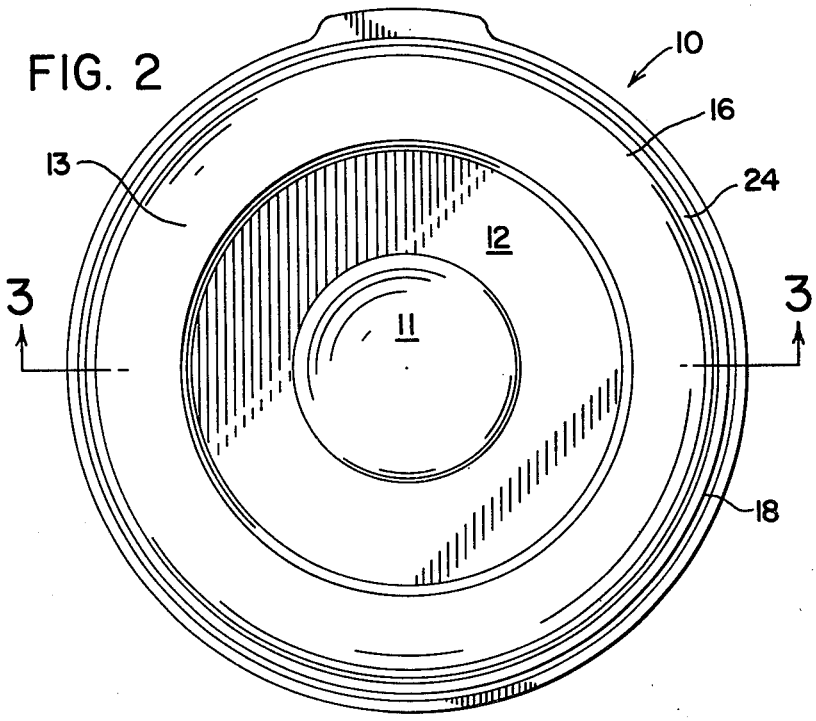
FIG. 2 is a top plan view of the improved lid.
Figure 3:
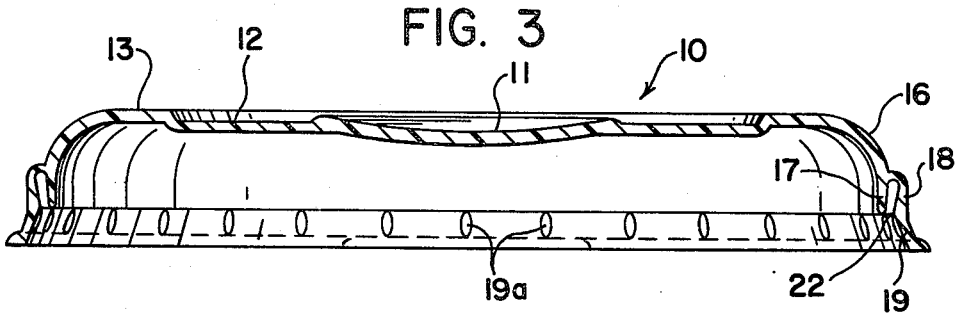
FIG. 3 is a sectional view on line 3—3 of FIG. 2.
Figure 4:
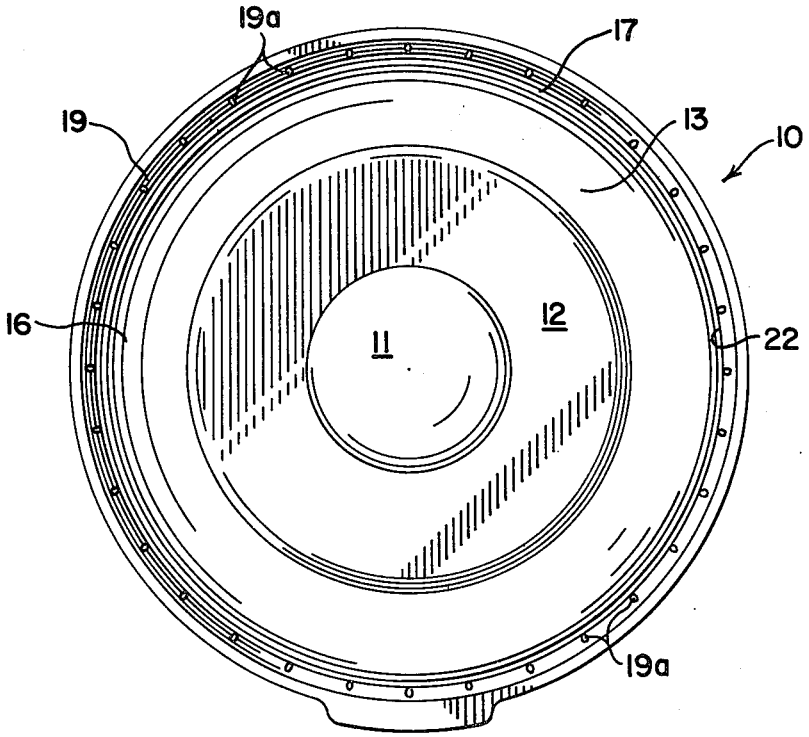
FIG. 4 is a bottom plan view of the improved lid.

Referring to FIGS. 2 and 3 of the drawings, the improved lid is upwardly bulged and is preferably dome shaped, having a substantially horizontal top wall indicated generally at 10 with a slightly downwardly curved medial portion 11 delineating the center press area. A flat annular area 12 encircles the medial area 11 and is preferably slightly recessed below the outer annular portion 13 of the rim, thus forming a centering area for stacking another bowl such as shown at 15 in FIG. 1 on top of the lid 10.

Figures 5, 6, 7:
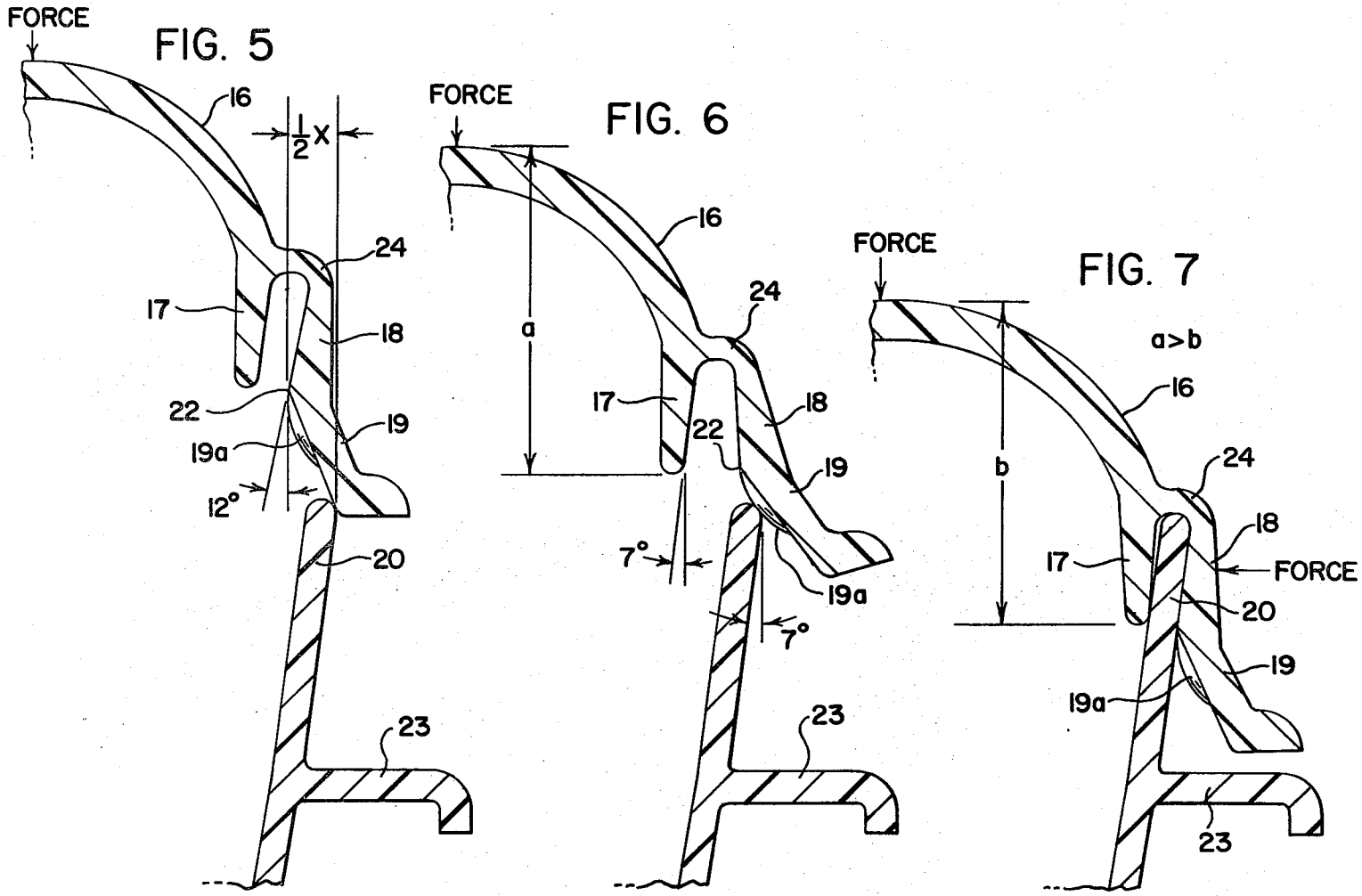
FIGS. 5, 6 and 7 are enlarged partial sectional views showing progressively the coaction between the lid and bowl rim as the lid is pressed down at the center to complete the seal.

From the outer periphery of annular portion 13 the lid is preferably downwardly curved as shown at 16, terminating in a downwardly directed inverted U-shaped channel having a relatively short inner flange 17 and a relatively long outer flange 18 terminating in an outwardly flared skirt 19. The outer surface of the inner flange 17 of the channel is inclined inwardly downward to match the inclination of the upper rim 20 of the bowl 15 (preferably about 7°) as best seen in FIG. 6. The inner surface of the upper part of outer flange 18 is downwardly inclined inwardly at a somewhat greater angle (preferably about 12°) and the inner surface of the skirt is downwardly inclined outwardly (preferably at angle of about 21°) forming a sharp circumferential shoulder 22 at the base of the channel. The inner surface of the skirt 19 is preferably provided with a circumferential series of nibs or beads **19*a* for a purpose to be described. Preferably, the bowl 15 has a horizontal exterior stiffening flange 23 slightly below the skirt 19 of the lid when it is in sealing position, as shown in FIG. 7**.

As shown in FIG. 5, when the lid is placed over the bowl the upper edge of the bowl rim 20 engages the inner surface of the skirt 19 near the bottom of the lid. Downward pressure applied to the medial area 11 then causes the inner surface of the skirt to slide downwardly over the top edge of the bowl rim 20 as shown in FIG. 6, outwardly flexing flange 18 about its upper end 24 until shoulder 22 rides over the top of bowl rim which audibly snaps into the position of FIG. 7, completing the seal. As previously stated, substantially half of the bowl rim first seats in the channel when center pressure is applied to the lid, and the other half seats progressively until the mid point audibly snaps to the position of FIG. 7, signaling completion of the seal. The nibs or beads **19*a*** allow the compressed air to escape as the lid is pressed down over the bowl.

The stiffness of the lid, together with the depth of the curve and the flexibility and inner diameter of the outer rim flange 18 must all be coordinated so that when a moderate center pressure is applied to the lid with one hand the lid has sufficient beam strength to transfer the force radially outward and flex the flange 18, allowing it to slide or cam over the bowl rim and audibly snap into final sealing position, and so that when the center pressure is released the radial inward force will draw the flange 18 radially inward to effect a tight seal against the bowl rim. The inner flange 17 is not relied on to seal against the inner surface of the bowl rim as the radial inner force transmitted through the lid when pressure is released detracts from the tightness of its engagement with the bowl. The flange 17 merely acts as a guide to initially position the lid.

Obviously, when a bowl containing food is sealed with the improved lid and placed within a refrigerator the resulting radial contraction of the lid increases the tightness of the seal rather than reducing it.

Figure 9:
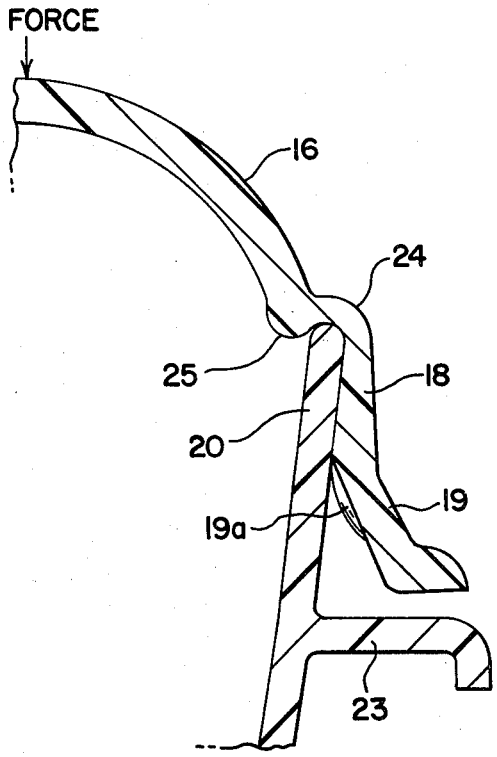
FIG. 9 is an enlarged sectional view similar to FIG. 7, showing the completed seal between the lid and the bowl rim.
Figure 8:
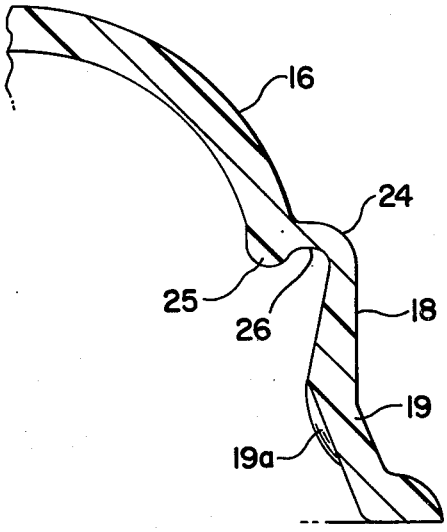
FIG. 8 is an enlarged sectional view of the rim portion of a modified embodiment of the improved lid which is otherwise identical in construction to the embodiment of FIGS. 1–7.

The modified embodiment of lid shown in FIGS. 8 and 9 is identical in construction to the lid of FIGS. 1–7, except for omitting the inner flange 17 of the previous embodiment and replacing it with a circumferential bead 25 forming a shallow groove or shoulder 26 under the upper end 24 of outer flange, adapted to engage the top of the bowl rim. It has been found that this modified embodiment produced a tight seal comparable to that produced by the embodiment of FIGS. 1–7.

The improved lid combines the convenience of a simple one hand center press application with a tight outside seal on a smooth bowl rim which is enhanced under refrigeration, while at the same time utilizing the full capacity of the bowl. The unique construction provides for an audible click when the lid snaps into place thereby signaling to the user that the seal is complete.

I claim:

1. A resilient plastic lid adapted to form a tight seal with the outer surface of the upper rim of a container, said lid having a top wall having a downturned periphery terminating in an outer rim flange for fitting over the container rim, the inner diameter of said rim flange being slightly less than the outer diameter of said container rim, said top wall having such resiliency and beam strength that when pressed downwardly at its medial portion said rim flange will flex outwardly and snap over the container rim with an audible click, and when released will draw said rim flange radially inward to tighten its sealing engagement with the container rim.

2. A resilient plastic lid as defined in claim 1, wherein the material of said lid is linear low density polyethylene.

3. A resilient plastic lid as defined in claim 2, wherein said lid rim flange forms an inner shoulder for engaging the top of the container rim.

4. A resilient plastic lid as defined in claim 3, wherein the inner diameter of said rim flange is about 0.050 inches to about 0.090 inches less than the outer diameter of the container rim on which it fits.

5. A resilient plastic lid as defined in claim 4, wherein said rim flange forms one side of a groove for fitting over the container rim.

6. A resilient plastic lid as defined in claim 5, wherein said outer rim flange terminates in an outwardly flared skirt.

7. A resilient plastic lid as defined in claim 1, wherein said rim flange forms an inner shoulder for engaging the top of the container rim.

8. A resilient plastic lid as defined in claim 7, wherein the inner diameter of said rim flange is about 0.050 inches to about 0.090 inches less than the outer diameter of the container rim on which it fits.

9. A resilient plastic lid as defined in claim 8, wherein said rim flange forms one side of a groove for fitting over the container rim.

10. A resilient plastic lid as defined in claim 9, wherein said outer rim flange terminates in an outwardly flared skirt.

11. A resilient plastic lid as defined in claim 1, wherein the inner diameter of said rim flange is about 0.050 inches to about 0.090 inches less than the outer diameter of the container rim on which it fits.

12. A resilient plastic lid as defined in claim 11, wherein said rim flange forms one side of a groove for fitting over the container rim.

13. A resilient plastic lid as defined in claim 12, wherein said outer rim flange terminates in an outwardly flared skirt.

14. A resilient plastic lid as defined in claim 1, wherein said outer rim flange terminates in an outwardly flared skirt.

* * * * *